United States Patent [19]

Eatock

[11] 4,064,448

[45] Dec. 20, 1977

[54] BAND GAP VOLTAGE REGULATOR CIRCUIT INCLUDING A MERGED REFERENCE VOLTAGE SOURCE AND ERROR AMPLIFIER

[75] Inventor: Fred L. Eatock, San Jose, Calif.

[73] Assignee: Fairchild Camera and Instrument Corporation, Mountain View, Calif.

[21] Appl. No.: 743,735

[22] Filed: Nov. 22, 1976

[51] Int. Cl.[2] ..... G05F 1/56

[52] U.S. Cl. ..... 323/22 T; 307/297

[58] Field of Search ..... 323/1, 4, 9, 22 R, 22 T; 307/296, 297

[56] References Cited

U.S. PATENT DOCUMENTS

| | | | |
|---|---|---|---|
| 3,828,240 | 8/1974 | Keller et al. | 323/22 T |
| 3,983,473 | 9/1976 | Sanderson | 323/22 R |
| 4,017,788 | 4/1977 | Stepp et al. | 323/22 T |

OTHER PUBLICATIONS

IEEE Trans. Broadcast & Telev. Receivers, vol. BTR-18, No. 2, May 1972; "A New Dimension To Monolithic Volt. Reg." by Chu et al., pp. 73-76.

IEEE Spectrum Apr. 1970, vol. 7, No. 4, pp. 24-32, "Monolithic Volt Regulators" by Kesner.

*Primary Examiner*—Gerald Goldberg

*Attorney, Agent, or Firm*—Alan H. MacPherson; Norman E. Reitz; Henry K. Woodward

[57] ABSTRACT

An improved circuit for a band gap voltage regulator is provided with a merged reference voltage source and error amplifier wherein the circuit operates simultaneously as a generator of the internal reference voltage as well as the small signal error amplifier for comparing a fraction of the output voltage to the reference voltage.

3 Claims, 4 Drawing Figures

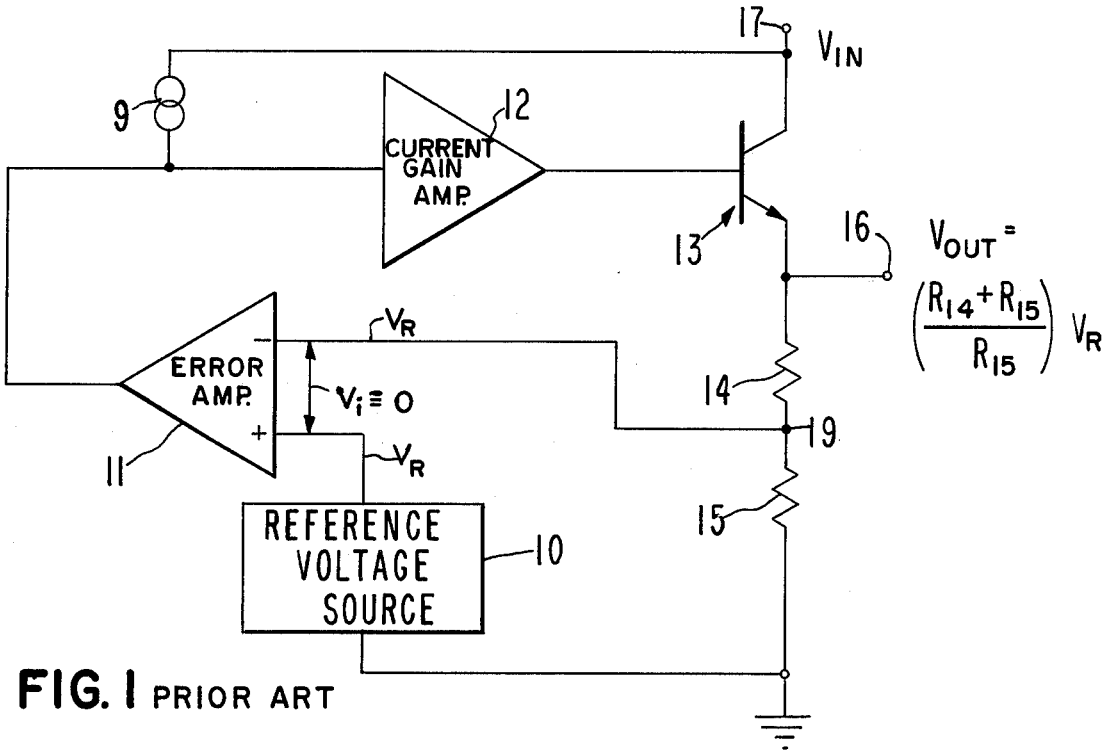
FIG. 1 PRIOR ART
FIG. 2
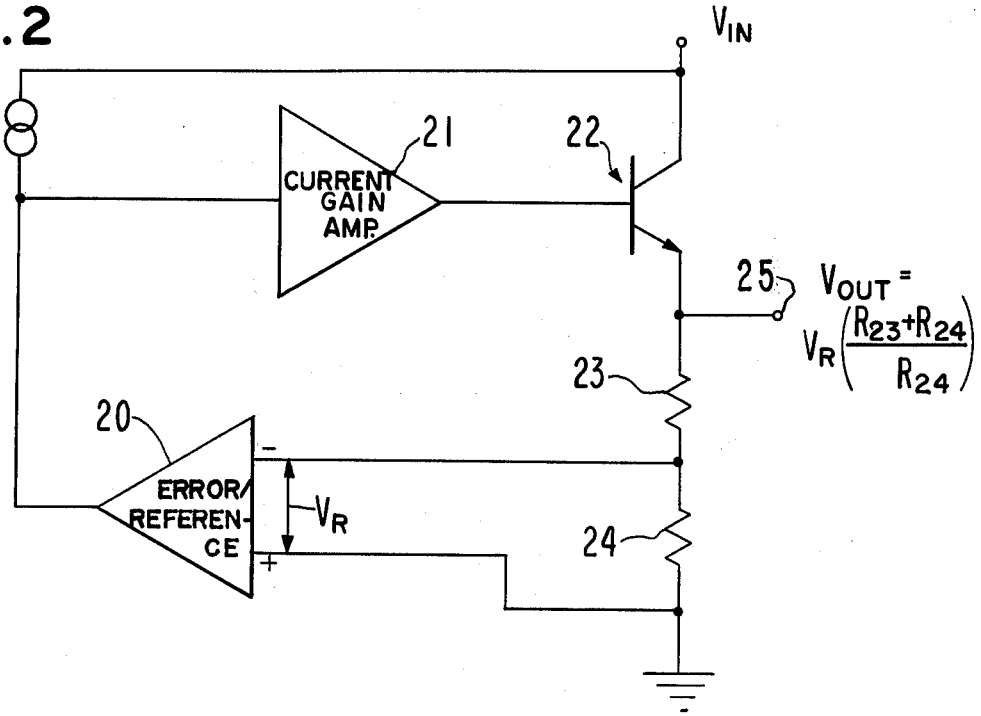

BAND GAP VOLTAGE REGULATOR CIRCUIT INCLUDING A MERGED REFERENCE VOLTAGE SOURCE AND ERROR AMPLIFIER

This invention relates to band gap voltage regulators suitable for monolithic fabrication and, more particularly, relates to a band gap voltage regulator incorporating a merged reference voltage source and error amplifier.

Voltage regulators of the monolithic band gap type with active feedback are achieving widespread use. They are rapidly replacing low power discrete, modular, and hybrid voltage regulators which utilize zener diode references. This widespread use of band gap regulators is occurring because they generally provide better line and load regulation performance at a favorable cost to the user.

Band gap voltage regulators typically comprise an internal reference voltage source, a separate error amplifier and a power output stage. The value of the reference voltage generated by the reference voltage source is a convenient fraction of the desired output voltage. The error amplifier then compares the reference voltage with a fraction of the actual output voltage and drives the output stage to keep the two compared voltages equal. This feedback technique produces an actual output voltage which is continuously maintained at the desired level. Voltage regulators of the band gap type are so named because the reference voltage sources produce a zero temperature coefficient reference voltage proportional to the semiconductor material band gap voltage by generating the difference, $\Delta V_{BE}$, between the base-emitter voltage of a pair of matched transistors, scaling this $\Delta V_{BE}$ voltage appropriately and adding this scaled $\Delta V_{BE}$ voltage to the base-emitter voltage of another transistor. The reference voltage so developed is usually an integer multiple of the semiconductor band gap voltage. For a description of this type of band gap regulator which utilizes variable collector currents in a monolithic integrated circuit, see U.S. Pat. No. 3,617,859. For a description of this type of regulator using variable emitter areas, see A. P. Brokaw, "A Simple Three-Terminal IC Band Gap Reference", IEEE Journal of Solid State Circuits, Vol. SC-9, No. 6, December 1974, p. 388.

When voltage regulators of the band gap type are fabricated in monolithic integrated-circuit form the reference voltage source, the error amplifier and associated control circuitry can occupy on the order of one-third to one-half of the active area of the circuit. For low-power voltage regultors the percentage of the total chip area occupied by these components can reach as high as eighty percent. It is known that the cost per regulator can be significantly reduced if die size is lowered since more regulators per wafer can be fabricated and less material is used per function performed. Alternately, the reduction in die size permits additional circuitry and thus additional functions to be incoporated in the same chip area as previously utilized. Thus, it is beneficial in general to reduce the number of components in a given circuit while performing the same function or to use the same circuit in multiple modes of operation.

SUMMARY OF THE INVENTION

The present invention comprises an improved band gap voltage regulator which merges the reference voltage source and error amplifier and in which the circuit simultaneously operates to generate the internal reference voltage and functions as a small signal error amplifier for comparing a fraction of the output voltage to the reference voltage.

BRIEF DESCRIPTION OF THE DRAWINGS

For a more thorough understanding of the present invention, reference may be had to the drawings which are incorported herein by reference and in which:

FIG. 1 is a generalized block diagram of a typical band gap voltage regulator;

FIG. 2 is a block diagram of the voltage regulator of the present invention which incorporates a merged reference voltage source and error amplifier;

DESCRIPTION OF THE PREFERRED EMBODIMENT

Figure 3:
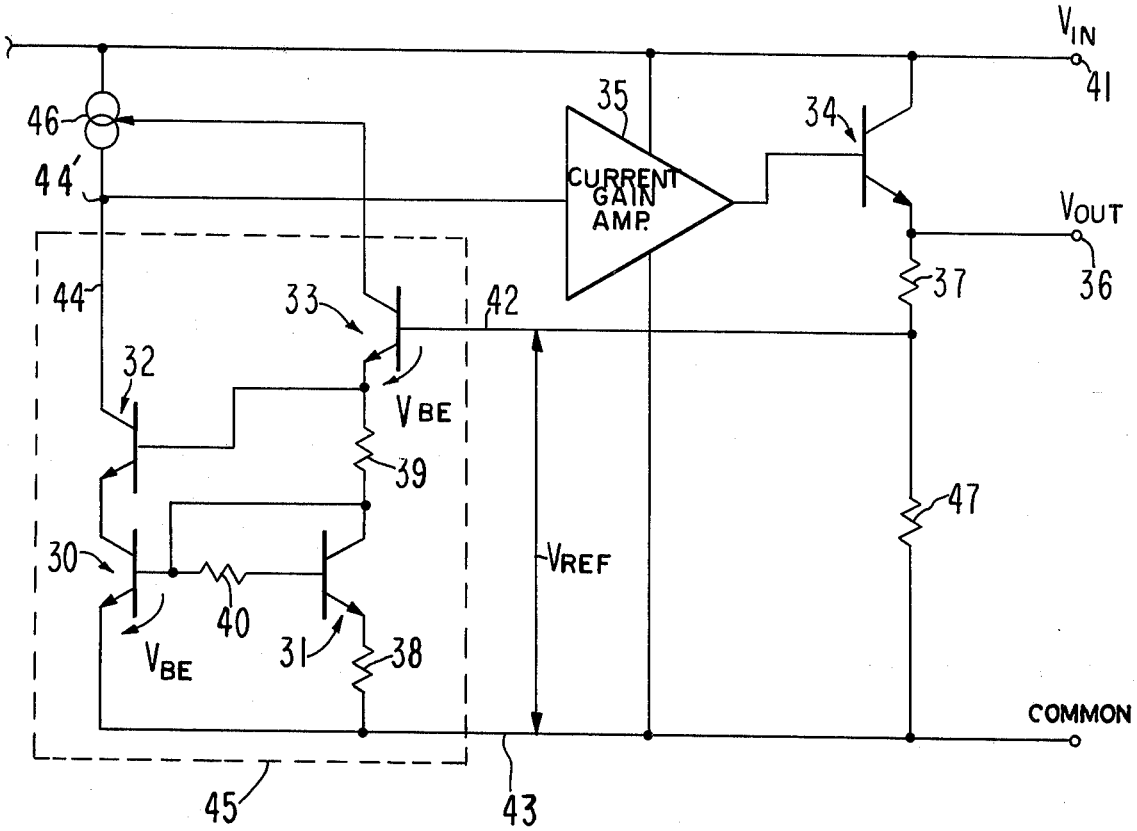
FIG. 3 is a schematic diagram of the merged circuit incorporated in the present invention shown in a context which illustrates its operation as a reference voltage source.

The generalized functionality of a band gap voltage regulator is illustrated in FIG. 1. Specific functionality may be obtained by reference to data sheets for band gap regulators such as the Fairchild UA7800 series. In FIG. 1 the input line voltage is presented to terminal 17. Current source 9 provides bias current to the error amplifier 11 and to the current gain amplifier 12 so as to cause output transistor 13 to conduct current to the output terminal 16 and to the output divider network consisting of resistors R14 and R15. Initially, the voltage presented to the divider network is limited only by the combined current gains of the current gain amplifier 12 and the output transistor 13 but the voltage reference source 10 in combination with feedback ultimately determines the output voltage pesented to terminal 16 as described below. The output of reference voltage source 10 is introduced as one input to error amplifier 11, commonly a two-stage operational amplifier. The other input to error amplifier 11 is taken from terminal 19 at the center of the output voltage divider network formed ;by resistors R14 and R15. The output current of error amplifier 11 is introduced to current gain amplifier 12 whose output drives power output device 13 which controls the voltage present at terminal 16. The voltage at node 19 must be equal to $V_R$ or else an error signal will be generated by error amplifier 11 to cause current gain amplifier 12 to produce a new voltage on the base of power output device 13 so as to maintain the voltage present at terminal 16 at a constant value. The values of resistors R14 and R15 are selected so that the voltage $V_R$ is present at node 19 when the output or load voltage at terminal 16 is at the desired output voltage value. The output voltage at terminal 16 is thus given in terms of the values of the resistors as $$V_{out} = V_R \frac{(R_{14} + R_{15})}{R_{15}}$$

This active feedback control system provides excellent line and load regulation performance but requires a separate reference voltage source 10 and error amplifier 11.

As can be seen from the band gap voltage regulator of the present invention, shown in general block diagram form in FIG. 2, the same overall function is performed by using a merged reference voltage source and error amplifier 20. As discussed in the preceeding paragraph the value of the output voltage at terminal 25 is given by the formula:

$$V_{out} = \frac{(R_{23} + R_{24})}{R_{24}} V_R$$

In FIG. 2, the merged reference voltage source and error amplifier 20 is designated generally as an operational type amplifier having an intentionally large offset voltage of a predictable polarity, temperature coefficient, and value. See, e.g., Tobey, et al., "Operation Amplifiers: Design and Applications". As will be discussed subsequently, the merged circuit operates simultaneously in two distinct modes of operation to permit the two functions to be performed. Simultaneous operation can occur because the reference voltage source operates in a direct current mode with values on the order of volts while the error amplifier function operates in an alternating current mode with low voltages on the order of millivolts. In essence, the error amplifier function is performed by modulating the reference voltage souce function.

Figure 4:
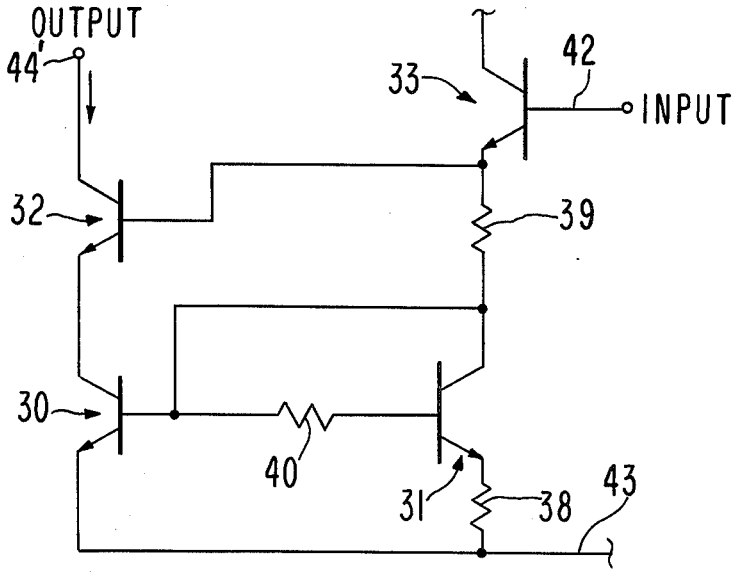
FIG. 4 is a schematic diagram of the merged circuit incorporated in the present invention which illustrates its operation as an error amplifier.

A circuit which performs the merged error amplifier and reference voltage source functions is shown within dotted line 45 in FIG. 3 and in the totality of FIG. 4. The circuit is shown in FIG. 3 with supporting components in order to describe the mode of operation in which the circuit functions as a reference voltage source. By reference to FIG. 4 it can be seen that the circuit in the reference voltage source mode is identical to the circuit in the error amplifier mode. The difference in the two modes of operation as will be seen from the subsequent discussion, lies in the character of the inputs and outputs, and in the points at which the inputs are impressed and the outputs are derived from the circuit.

In the following discussion, high beta NPN transistors (transistors in which the ratio of collector current to base current approaches infinity) are assumed. Referring to FIG. 3, and in the voltage source mode of operation, a reference voltage is determined by the base-emitter voltages of transistors 30 and 33 plus the voltage drop across resistor 39. The dependent current source 46 forces equal collector currents in transistors 30 and 31 so that a voltage, referred to as $\Delta V_{BE}$, dependent upon the emiter areas ratio of transistors 30 and 31 is impressed across resistor 38. This voltage, $\Delta V_{BE}$, as impressed across resistor 38, also determines the operating collector currents of transistors 30 through 33 when the voltage feedback loop is complete. Mathematically, the voltage $\Delta V_{BE}$ and the corresponding collector currents of transistors 30 through 33 can be expressed by equations 1 and 2 as follows:

$$\Delta V_{BE} = \frac{kT}{q} \ln \left[ \frac{A_{E31}}{A_{E30}} \right] \quad (1)$$

$$I_{C30} \cong I_{C31} \cong I_{C32} \cong I_{C33} \cong \frac{1}{R_{38}} \cdot \frac{kT}{q} \ln \left[ \frac{A_{E31}}{A_{E30}} \right] \quad (2)$$

where $k$ = Boltzmann's constant
$T$ = Kelvin temperature
$q$ = charge of the electron
$kT/q = 2.585 \times 10^{-2}$ volts at 300° K.
$A_{E30}$, $A_{E31}$ = emitter areas of transistors 30 and 31, respectively,
$R38$ = resistor 38
$ln$ = the natural logarithm
$I_{C30}$ through $I_{C33}$ = collector currents in transistors 30 through 33, respectively.

This predictable voltage, $\Delta V_{BE}$, can be readily shown to have a positive temperature coefficient as follows in equation (3):

$$\frac{\partial}{\partial T} [\Delta V_{BE}] = \frac{\partial}{\partial T} \left[ \frac{kT}{q} \ln \left( \frac{A_{E31}}{A_{E30}} \right) \right] = \frac{k}{q} \ln \left[ \frac{A_{E31}}{A_{E30}} \right] = \Delta \frac{V_{BE}}{T} \quad (3)$$

Therefore $\partial/\partial T(\Delta V_{BE})$ has a positive temperature coefficient since both $\Delta V_{BE}$ and T are positive real numbers. Now, since high beta NPN's have been assumed, the voltage across resistor 39 is:

$$V_{39} = I_{C31} R_{39} = \frac{R_{39}}{R_{38}} \cdot \frac{kT}{q} \ln \left( \frac{A_{E31}}{A_{E30}} \right) = \frac{R_{39}}{R_{38}} \Delta V_{BE}$$

which must also have a positive temperature coefficient as the ratio $R_{39}/R_{38}$ is temperature-independent. Thus the voltage at the base of transistor 33 and between lines 42 and 43 — the reference voltage $V_{REF}$, can be shown to be given by the following equations (4) and (5)

$$V_{REF} = V_{BE30} + V_{BE33} + \frac{R_{39}}{R_{38}} \cdot \frac{kT}{q} \ln \left( \frac{A_{E31}}{A_{E30}} \right) \quad (4)$$

or $$V_{REF} = 2V_{BE} + \frac{R_{39}}{R_{38}} \cdot \frac{kT}{q} \ln \left( \frac{A_{E31}}{A_{E30}} \right) \quad (5)$$

since transistors 30 and 33 are designed as identical geometrical structures. Since the first term of equation (5) on the right-hand side has a negative temperature coefficient and the second term has a positive temperature coefficient, a set of values for R38 and R39 can be found to give the reference voltage, $V_{REF}$, a zero temperature coefficient. For the circuit under consideration, this happens for $V_{REF} \cong 2.56$ volts. In a practical integrated circuit, beta is not always the very high value assumed above, so that the circuit operation is slightly affected by the base currents of the various transistors. The effects of these finite betas is minimized by a resistor 40 which compensates for the base current errors introduced.

The output voltage available at terminal 36 is then related to the reference voltage by equation (6):

$$V_{OUT} = \frac{(R37 + R47)}{R47} V_{REF} \quad (6)$$

Essentially, the output voltage at terminal 36 is determined by the circuit within the dotted lines 45 which has a zero temperature coefficient. $V_{REF}$ is generated between lines 42 and 43 to control power output device 34. This is accomplished because the current into line 44, tied through terminal 44 to the input of current gain amplifier 35, varies as necessary to maintain the proper mathematical relationships of $V_{REF}$ when the feedback loop is closed by resistors 37 and 47. The combination of current gain amplifier 35 and power output transistor 34 functions as a power output stage. The output voltage $V_{OUT}$ at terminal 36 is maintained by the power output stage at the desired value independent of input voltage or output load.

The error amplifier mode of operation of the circuit incorporated in the present invention is shown in FIG. 4. To understand the operation of this circuit as an amplifier consider the following. If the voltage difference between lines 42 and 43 is increased gradually from zero to a value larger than the reference voltage, the currents $I_{C32}$ and $I_{C33}$ likewise increase. Due to the relatively large resistor values of resistors 38 and 39, on the order of kilohms, however, $I_{C33}$ increases approximately linearly with voltage while $I_{C32}$ increases approximately exponentially in the region where $I_{C32} \cong I_{C33} \cong \Delta V_{BE}/R38$. It is the act of completing the feedback loop around the nonlinear regulator amplifier through resistors 37 and 47, shown in FIG. 3, which establishes the equilibrium operating currents of transistors 30 through 33 at the current $\Delta V_{BE}/R38$.

Near the equilibrium operating current, one can consider the effects of small perturbations of the voltage on line 42 with respect to line 43 as observed at the amplifier output terminal 44. For these small perturbations the change in output current $i_{OUT}$ as a function of the small input voltage on line 42, $v_{IN}$, can be characterized as a linear function and under small signal linear analysis, a transconductance function is defined as $g_m = i_{OUT}/v_{IN}$. The transconductance of the circuit incorporated in the present invention in the error amplifier mode, then, is given by equation (7).

$$g_m = \frac{i_{OUT}}{V_{IN}} \cong \left(\frac{\beta}{\beta + 1}\right)\left[\frac{g\,ml\,(1 + g\,ml \cdot R38)}{2 + g\,ml\,(R39 + R38)}\right] \quad (7)$$

where $g_m$ = transconductance of the amplifier stage and is defined as the ratio of the samll signal output current change to the change of input voltge producing it and is equal by definition to $i_{OUT}/V_{in}$.

$\beta$ = transistor current gain, $I_C/I_B$.

$gml = qI_{C31}/kT$

R38, R39 are the values of resistors 38 and 39 in FIG. 4.

For the preferred embodiment the transconductance is about 250 microhms. Thus, although the transconductance of the amplifier stage is relatively low, it can be made an effective error amplifier if the load impedance at node 44' is large. This requirement can be easily met with relatively simple circuitry incorporated into the current gain amplifier 35 which must only provide a large current gain.

In operation, the range of direct current levels permissible for transistors 30 through 33 is from the tens of microamperes to about the milliampere level. The limitation is the practical one of the chip area which the resistors R38 and R39 will occupy when fabricated in monolithic form. In any event, the range of current levels is wide enough and of an appropriate order of magnitude to permit the circuit to produce a reference voltage which is a convenient fraction of the desired output voltage. The amplitude of the small signal alternating current produced at node 44 by the error amplifier as set out in FIG. 4 is very small. To regulate 100 milliamperes of output direct current the alternating current would be on the order of nanoamperes or less. The alternating current associated with the error amplifier, then, is much smaller than the microampere level direct currents associated with the reference voltage source. Consequently, there is no impairment of the reference voltage function by impressing the error amplifier function over it.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. In a band gap voltage regulator wherein an internal reference voltage source and error amplifier are merged the improved circuit which comprises:

a first resistor;

a second resistor;

a first transistor;

a second transistor, the base of said second transistor being electrically connected to the collector of said first transistor and to the base of said first transistor, the emitter of said second transistor being electrically connected to the emitter of said first transistor through said first resistor;

a third transistor whose emitter is electrically connected to the collector of said second transistor; and a forth transistor whose emitter is electrically connected to the base of said third transistor and whose emitter is electrically connected through said second resistor to the collector of said first transistor.

2. A band gap voltage regulator in accordance with claim 1 wherein the reference voltage to said internal reference voltage function is derived at the base of said fourth transistor and wherein the input for said error amplifier function is impressed at the base of said fourth transistor and the error amplifier output is taken from the collector of said third transistor.

3. A band gap voltage regulator in accordance with claim 2 in combination with a third resistor inserted between said base of said second transistor and said base of said first transistor.

* * * * *